United States Patent [19]

Schräwer

[11] 3,994,141

[45] Nov. 30, 1976

[54] PROCESS FOR COOLING BY MEANS OF A CRYOGEN SLUSH

[75] Inventor: Rolf Schräwer, Bruchkobel, Germany

[73] Assignee: Messer Griesheim GmbH, Germany

[22] Filed: May 12, 1975

[21] Appl. No.: 576,850

[30] Foreign Application Priority Data

May 15, 1974 Germany .....2423681

[52] U.S. Cl. ..... 62/76; 62/9; 62/48; 62/514 R

[51] Int. Cl.[2] ..... F17C 7/02

[58] Field of Search ..... 62/48, 514 R, 76, 8, 62/9

[56] References Cited

UNITED STATES PATENTS 3,810,365 5/1974 Hampton et al. ..... 62/48

OTHER PUBLICATIONS

Kocher, R. M. et al.: *Prelaunch Slush Hydrogen Loading Factors Affecting Instrumentation and Control*, Advances in Cryogenic Engineering vol. 14 pp. 306–310.

*Primary Examiner*—William E. Wayner
*Assistant Examiner*—Ronald C. Capossela
*Attorney, Agent, or Firm*—Connolly and Hutz

[57] ABSTRACT

A process for cooling by means of a low-boiling gas comprises the steps of continuously producing a gas slush and conveying it from the location of its production to the place of consumption. The gas slush releases its heat of fusion at the place of consumption and becomes a triple-point liquid. The liquid is returned to the location of production to produce fresh slush.

1 Claim, 1 Drawing Figure

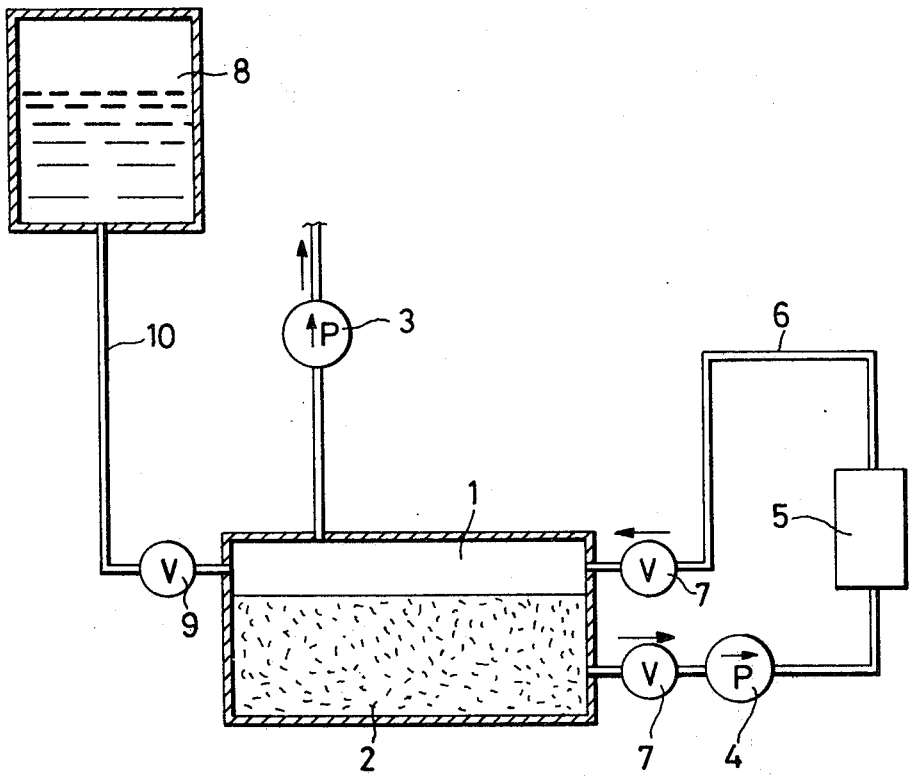
8
10
P
3
6
1
5
V
9
V
7
V
7
P
4
2

PROCESS FOR COOLING BY MEANS OF A CRYOGEN SLUSH

BACKGROUND OF THE INVENTION

The present invention relates to a process for cooling by means of a low-boiling gas, in particular for such cases in which a high refrigerating capacity at very low temperature level is required for a limited period. Generally, these cryotechniques involve the production and application of very low temperatures.

Such a refrigerating capacity is necessary for many physical experiments. For this, liquid nitrogen or liquid hydrogen is produced from case to case in a gas-liquefier, according to the requirement, and conducted to the place of the consumption. Because of the discontinuous operation, the equipment must first be operated cold, and this is time consuming and expensive.

Furthermore, transportation of the boiling-point liquid is expensive since two-phase flow of gas and liquid, with high resistance to flow, develops. Often the temperature level is still too high, e.g. in the investigation of superconductors at temperatures of the liquid hydrogen.

SUMMARY AND DETAILED DESCRIPTION OF THE INVENTION

The invention involves a process for cooling by means of a low-boiling gas, which makes it possible to store the cooling medium during periods of nonuse, and to bring it to the place where it is needed without great transportation expenses. The cooling medium has a very low temperature level.

According to the invention, slush is continuously produced from the gas and when needed is forwarded from a container to the place of consumption where it gives off its heat of fusion. The thus formed triple point liquid is then recycled to produce fresh slush.

Slush is a mixture of liquid and ice, which is at the triple point in equilibrium with the gas phase. When the slush is pumped through pipe lines, the occurring pressure loss coefficients are within the range of Reynolds number $>10^5$ comparable with those of the liquid. The heat transfer properties of the cold-carrier are then determined by the laws of turbulent, compulsory convection; therefore, one can at small temperature differences and exchange surfaces transfer large amounts of heat.

When one considers the cold production from the thermodynamic standpoint, the following points of view result from the Carnot process. If the necessary cold level is not very substantially below the surrounding temperature, then the work, which has to be employed per Kcal, is minimum, and storage is not profitable because of the lack of space. Of course, at very low temperatures, the specific performance requirement increases considerably, and with it also the expenditure of work, stored per unit of volume of the slush.

The capacity of storage depends very decisively upon the insulation quality of the containers. When so-called superinsulation is used, slush storage is obtained without almost any losses.

The volume of the insulated slush container is so dimensioned that the heat of fusion stored in the portion of solid material of the slush is sufficient to supply the place of the consumption during the working hours with the necessary cooling capacity. For this purpose, the slush is transported with a turbo-pump over superinsulated transportation lines. After releasing its heat of fusion, it returns as triple point liquid into the storage container, and it is converted again into slush.

The use of a slush of low-boiling gases as a cooling medium, according to the invention, makes possible an excellent maximum satisfaction of needs at low energy and investment costs. The current requirement is constant, because the production of cold is uniform. Therefore, a capacity leveling takes place. Advantageous is furthermore the possibility of overloading, since the cold of the liquid is utilized up to the boiling point temperature. Since the slush can be produced continuously, and can be stored, the periodic cold driving of the equipment is eliminated. Therefore, no temperature change load results, as it is typical for installations which are used only upon need for the production of liquid cold media, in the boiling state, are applied from low-boiling gases.

Although another aspect of the invention involves the cases of application, in which over a limited period of time a great cold efficiency is required at deep temperature level, it is however not limited to it. In certain cases it can also be of advantage not only to produce the slush continuously, but to use it with or without intermediate storage, continuously as a refrigerating medium in the boiling state from low-boiling gases.

Although one aspect of the invention resides in the cases of application, in which over a limited period of time a great cold efficiency is required at a low temperature level, it is however not limited to that. In certain cases, it is advantageous to not only produce the slush continuously, but to continuously use it with or without intermediate storage as a refrigerating medium.

Such a case is, for example, the cooling of a superconductor with a temperature between the triple point temperature and the boiling temperature of the low-boiling gas used as the cooling medium. Suitable are all low-boiling gases, such as nitrogen, hydrogen, argon, neon, oxygen, carbon monoxide and crypton. It is furthermore possible to cool superconductors with swing temperatures of 15° K by using hydrogen slush instead of cooling with liquid helium. Hydrogen slush is superior to the liquid helium because of its superior specific cooling work at a triple point temperature of 13.8° K. A further field of application is the cooling of magnets for magnet-cushion tractions.

Also, it must be investigated in the individual case whether the continuous production of slush with intermediate storage, with relatively deficient, installed, electric efficiency, is more economical than the production of boiling point liquid without intermediate storage, when needed in an installation with relatively high installed electric efficiency. This depends upon the kind of gas and upon the factors of its utilization. The factors of utilization indicate how many hours per day the installation is in operation.

One could also store a boiling point liquid and evaporate it when needed at the place of consumption. Aside from the poorer storage behavior at high temperature levels, this would require, as noted above, higher transportation expenses for the interphase flow gas-liquid so that such a mode of operation would not be advantageous.

The drawing shows the scheme of a slush storage installation. The insulated reservoir 1 is filled with slush 2, of a low-boiling gas, e.g. hydrogen.

The slush 2 is produced by pumping off the gas by means of the vacuum pump 3. The liquid cools at first to the triple point whereupon ice formation starts. If needed, the slush 2 is conveyed by means of the turbopump 4 to the place of consumption such as a cooling chamber 5. The transportation line is superinsulated. In the cooling chamber 5 the slush releases its heat of fusion and a triple point liquid remains which is returned to the reservoir 1 by conduit 6. The conduit between the reservoir 1 and turbopump 4 includes a valve 7, and a similar valve is provided between the conduit 6 and the reservoir.

The gas drawn off by the vacuum pump 3 is replaced by boiling point liquid from a storage container 8 connected to the reservoir 1 by a conduit 10. The conduit includes a valve 9.

The installation can also be operated so that the gas amount drawn off by the vacuum pump 3 is liquefied in a gas liquefier, and then returned to reservoir 1.

What is claimed is:

1. A process for cooling by means of a low-boiling gas comprising the steps of continuously producing a gas slush, conveying the gas slush from the location of its production to the place of consumption where it releases its heat of fusion, melts and becomes a triple-point liquid, and returning the liquid to the location of production to produce fresh slush.

* * * * *